US009896878B1

(12) United States Patent
Horton

(10) Patent No.: US 9,896,878 B1
(45) Date of Patent: Feb. 20, 2018

(54) REVERSIBLE DOOR JAMB SYSTEM

(71) Applicant: John Horton, Puyallup, WA (US)

(72) Inventor: John Horton, Puyallup, WA (US)

( * ) Notice: Subject to any disclaimer, the term of this patent is extended or adjusted under 35 U.S.C. 154(b) by 0 days.

(21) Appl. No.: 15/155,257

(22) Filed: May 16, 2016

Related U.S. Application Data

(60) Provisional application No. 62/267,244, filed on Dec. 14, 2015.

(51) Int. Cl.
*E06B 1/04* (2006.01)
*E06B 1/52* (2006.01)
*E06B 3/36* (2006.01)

(52) U.S. Cl.
CPC ..... *E06B 1/526* (2013.01); *E06B 3/36* (2013.01)

(58) Field of Classification Search
CPC ... E06B 1/10; E06B 1/526; E06B 3/36; E05D 7/02
See application file for complete search history.

(56) References Cited

U.S. PATENT DOCUMENTS 4,589,229 A * 5/1986 Warren ..... E06B 1/10 49/382
5,115,597 A * 5/1992 Tillery ..... E06B 1/526 49/504
5,347,780 A * 9/1994 Richards ..... B28B 1/525 49/504
5,365,708 A * 11/1994 Winston ..... E06B 1/10 49/504
5,515,658 A * 5/1996 Jorde ..... E06B 1/02 49/504
5,566,509 A * 10/1996 Long ..... E05B 15/0205 292/340
5,832,670 A * 11/1998 Bennett ..... E05D 7/02 49/193
5,901,511 A * 5/1999 Yoshida ..... E06B 1/10 49/504
6,516,494 B2 * 2/2003 Nakamoto ..... E05D 7/0027 16/236
6,588,159 B1 * 7/2003 Cotton, Jr. ..... E06B 1/08 49/504
6,672,021 B2 * 1/2004 Kusano ..... E05D 7/02 49/380
7,104,016 B2 * 9/2006 Kerr ..... E06B 1/526 52/204.1
2011/0314754 A1 * 12/2011 Griffin ..... E06B 1/526 52/204.2

* cited by examiner

*Primary Examiner* — Katherine W Mitchell
*Assistant Examiner* — Abe Massad
(74) *Attorney, Agent, or Firm* — Buskop Law Group, P.C.; Wendy Buskop

(57) ABSTRACT

A reversible door jamb system for an aperture. The mechanical design of the system allows for a single product to be utilized for doors which open in either direction, often referred to as left handed or right handed operation. The system can have a head jamb, a strike jamb, and a hinge jamb. A stop can be included which is adapted to attach to the head jamb, the strike jamb, or the hinge jamb. The strike jamb and the hinge jamb are interchangeable to allow for reversing the swing of a door panel.

5 Claims, 7 Drawing Sheets

REVERSIBLE DOOR JAMB SYSTEM

CROSS REFERENCE TO RELATED APPLICATION

The current application claims priority to and the benefit of U.S. Provisional Patent Application Ser. No. 62/267,244 filed on Dec. 14, 2015, entitled "REVERSIBLE DOOR JAMB SYSTEM". This reference is incorporated in its entirety herein.

FIELD

The present embodiments generally relate to a reversible door jamb system.

BACKGROUND

Based upon construction requirements and specifications, commercial and residential structures make use of numerous doors. The location and desired method of operation of these doors can vary considerably even within a single structure.

Doors can swing open on either side of a door frame based upon the location of the hinges. Often, this is described as left handed opening or right handed opening of the door.

Several doors configured to open in either manner may be required for every home, office, or other structure. Currently, the frame or door jambs that are used are not interchangeable between a left handed and right handed door.

This causes building supply stores, builders, contractors, and the like to carry extra inventory of parts which perform identical functions, but are not interchangeable.

Attempts have been made to use interchangeable parts, but the current state of the art for a door opening both right and left handedly requires that the door knob (or the bore for the door knob) be placed exactly symmetrically halfway between the bottom of the door panel and the top of the door panel. This is often not desirable, and has not gained popularity.

Further, contractors can often order the wrong parts for a door, or the handedness of the door may need to be changed during construction. This can result in construction delays, added construction costs, and additional labor required for return or replacement of the component parts.

A need exists for a system that utilizes interchangeable parts for the door frame or door jamb, allowing a door to open both right handedly and left handedly, while leaving the design of the door panel to remain unaffected.

A further need exists for a system that can be easily stored, shipped, and assembled, which saves inventory and storage costs.

The present embodiments meet these needs.

BRIEF DESCRIPTION OF THE DRAWINGS

The detailed description will be better understood in conjunction with the accompanying drawings as follows.

Figure 1B:
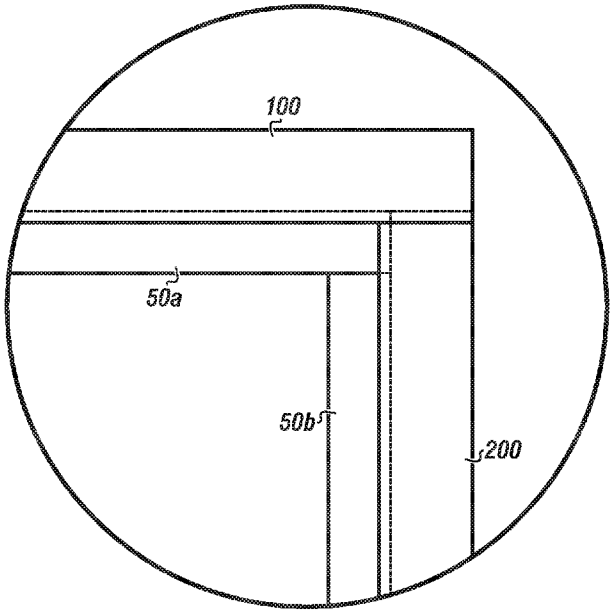
FIGS. 1A and 1B depict an assembled door frame according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The present embodiments relate to a reversible door jamb system for an aperture. The mechanical design of the system allows for a single product to be utilized for doors which open in either direction, often referred to as left handed or right handed operation.

The reversible door jamb system can have a door panel and a door frame for supporting the door panel. The door panel can of any design and can mount to the door frame in any manner commonly known to persons having ordinary skill in the art.

The door panel can have an asymmetric handle bore and a plurality of predrilled hinge routes to receive and attach to door hinges. In embodiments, the door panel can be from 72 inches to 120 inches in height.

In embodiments, the hinge routes can be rectangular, thereby allowing the door to be mounted to swing open either left handed or right handed. However, if the door is handed in a specific manner, it can still be used with the frame of the present embodiments.

The door frame can have a hinge jamb, a strike jamb, a stop, and a head jamb.

The hinge jamb can have a plurality of first hinge jamb routes to receive and attach to door hinges. The hinge jamb can also have a plurality of second hinge jamb routes positioned in a way to mirror the orientation of the plurality of first hinge jamb routes to receive and attach to door hinges. In this manner, the door hinges can be attached to the hinge jamb to open either left handedly or right handedly.

In embodiments, the hinge jamb can further comprise a first hinge jamb installation channel and a second hinge jamb installation channel positioned in a way to mirror the orientation of the hinge jamb installation channel. This can aid in receiving and attaching door hinges.

The strike jamb can be adapted for orientation substantially parallel to the hinge jamb. The strike jamb can have a first strike route and a second strike route positioned in a way to mirror the orientation of the first strike route.

In embodiments, the strike jamb can further comprise a first strike jamb installation channel and a second strike jamb installation channel, which can be channeled in a way to mirror the orientation of the first installation channel. This aids in properly installing the frame plumb and square as needed for ease of operation. The channel can also hide attachment mechanisms, such as screws, nails, bolts or other mechanisms.

The door frame can have a stop adapted to be mounted to the strike jamb or the hinge jamb. In embodiments, the stop can be adapted to be mounted to the head jamb. In embodiments, the stop can be an interior stop adapted to be mounted to an interior door frame. In embodiments, the stop can also be an exterior stop adapted to be mounted to an exterior door frame.

The door frame can also have a head jamb adapted to be oriented substantially orthogonally to the hinge jamb and the strike jamb. In embodiments, the head jamb can have a head channel. In embodiments, the head jamb can have a second head channel. This aids in properly installing the frame plumb and square needed for ease of operation. The channel can also hide attachment mechanisms, such as screws, nails, bolts or other mechanisms.

While the hinge jamb and the strike jamb are typically oriented vertically in a door frame, the head channel would span across the hinge jamb and the strike jamb in a horizontal fashion. Typically, the head channel would be mounted at the top of the hinge jamb and the strike jamb.

For the unusual instance in which a door may be required to swing in a different manner than that which is typically used, the relative orientations of the head jamb, the hinge jamb, and the strike jamb would remain consistent.

In embodiments, the hinge jamb and the strike jamb can be oriented on either side of the head jamb to allow the door panel to swing open in a desired direction.

Due to the fact that the hinge jamb, the strike jamb, and the head jamb are designed to be used in multiple orientations, there may be some cosmetic features that are undesirable. For example, the extra hinge jamb routes may be visible when installed.

These features can be easily concealed by a trim or a covering such as stucco. These are features that are currently used in the art, and no additional installation or labor would be necessitated by the present invention.

In embodiments for external door applications, the frame can also have a threshold. The threshold can be oriented substantially orthogonally to the hinge jamb and the strike jamb and positioned opposite the head jamb.

To aid in manufacture and storage of the present invention, a kit for constructing a reversible door jamb system can be prepared to allow for the easy construction of the above invention.

The door frame can have a hinge jamb, a strike jamb, a stop, and a head jamb. The kit can be packaged with the various components and optional features as described above for the system.

The system not only simplifies installation and construction, but can have the unique ability to be safely and conveniently utilized in industrial and residential applications. The installation and construction of the present invention minimizes the cost associated with installation of a door and provides a high degree of functionality, cost savings, and inventory reduction, while still meeting aesthetic requirements.

Figure 1A:
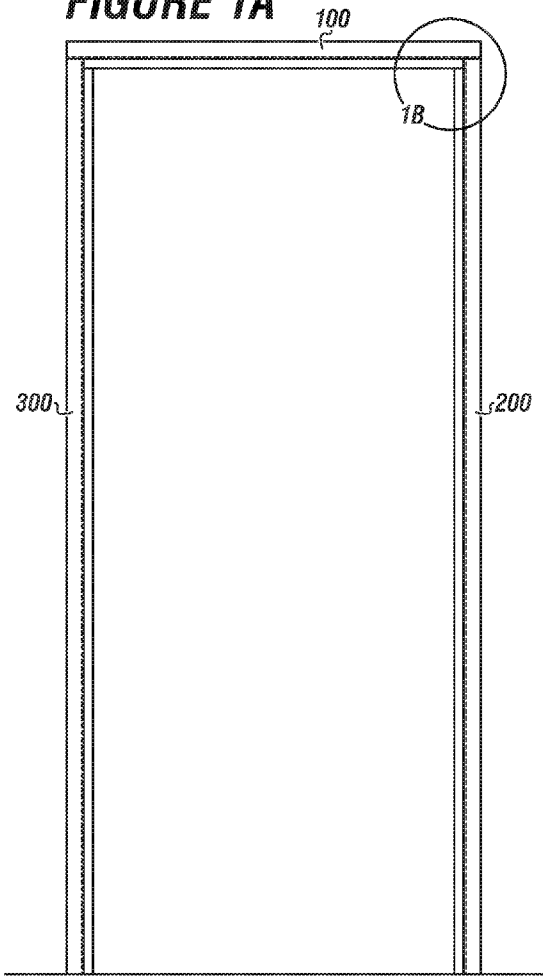

Turning now to the Figures, FIGS. 1A and 1B depict an assembled door frame according to one or more embodiments.

Shown in FIG. 1A is an embodiment of a head jamb 100, a strike jamb 200, and a hinge jamb 300. Detail in FIG. 1B shows a head jamb 100 with a stop 50*a* attached and a strike jamb 200 with a stop 50*b* attached. As shown the head jamb 100 is mounted substantially orthogonally to strike jamb 200 and hinge jamb 300.

Figure 2A:
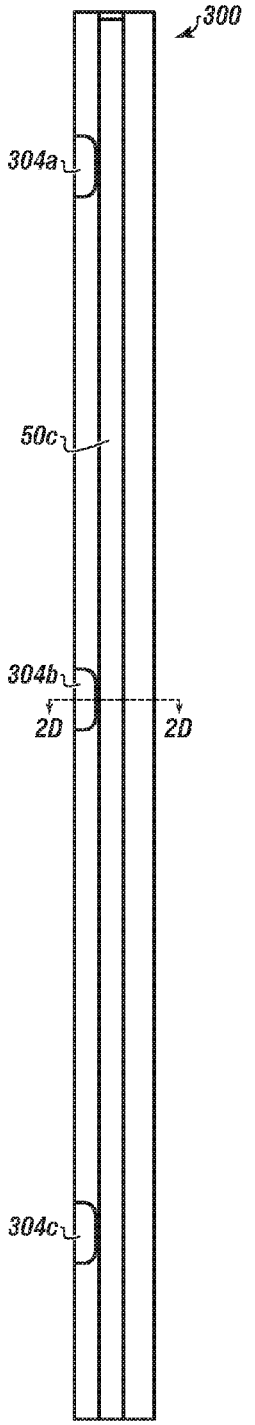
FIGS. 2A, 2B, and 2C depict a hinge jamb according to one or more embodiments.
Figure 2B:
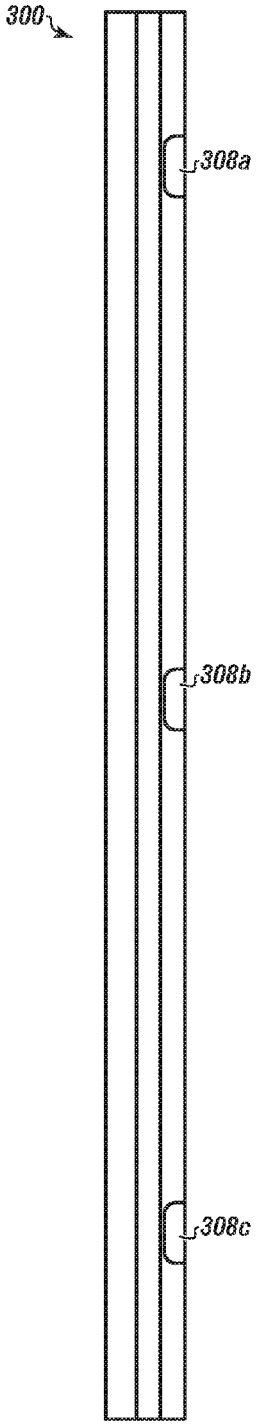
Figure 2C:
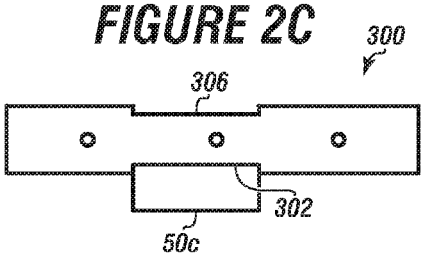
Figure 2D:
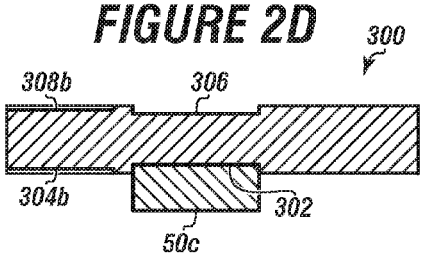
FIG. 2D depicts a cut view of FIG. 2A along line 2D-2D.

FIGS. 2A, 2B, and 2C depict a hinge jamb according to one or more embodiments. FIG. 2D depicts a cut view of FIG. 2A along line 2D-2D.

The hinge jamb 300 is shown with a plurality of first hinge jamb routes 304*a*-304*c* and a plurality of second hinge jamb routes 308*a*-308*c*. In embodiments, a first hinge jamb installation channel 302 or a second hinge jamb installation channel 306 can be included. Shown also is a stop 50*c*, adapted to be installed on either the hinge jamb 300 or the strike jamb.

Figure 3A:
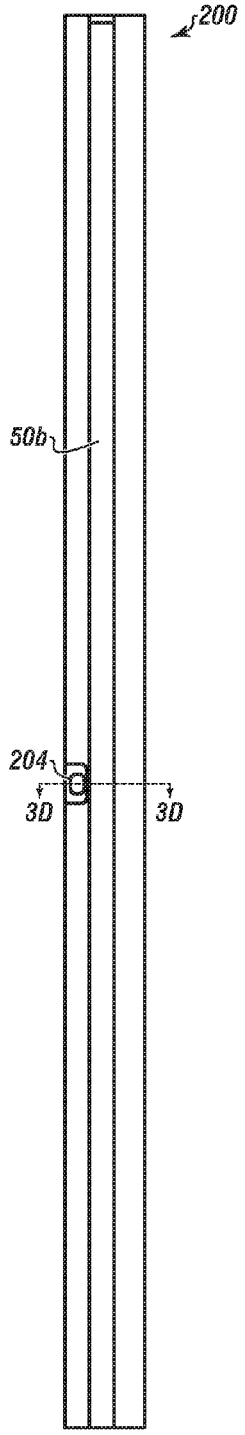
FIGS. 3A, 3B, and 3C depict a strike jamb according to one or more embodiments.
Figure 3B:
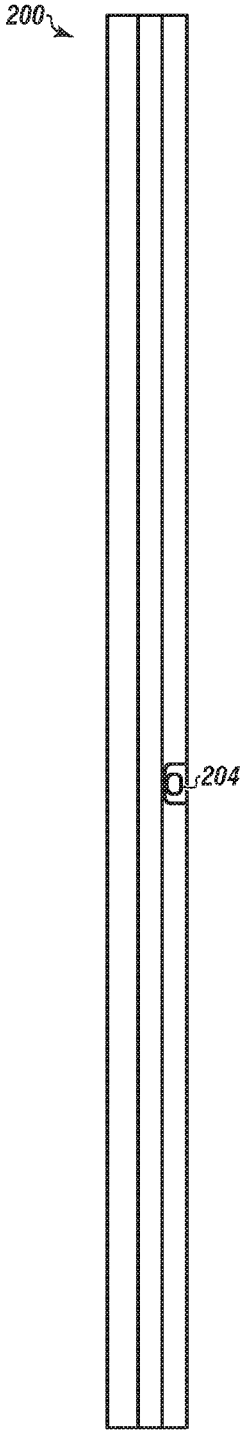
Figure 3C:
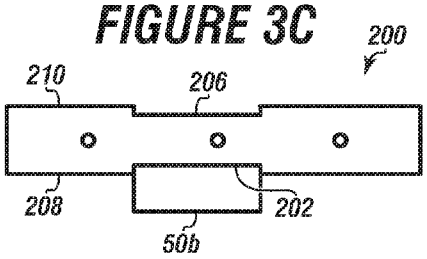
Figure 3D:
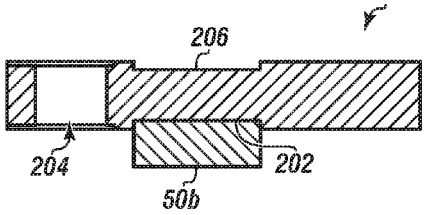
FIG. 3D depicts a cut view of FIG. 3A along line 3D-3D.

FIGS. 3A, 3B, and 3C depict a strike jamb according to one or more embodiments. FIG. 3D depicts a cut view of FIG. 3A along line 3D-3D.

The strike jamb 200 is shown with a first strike route 208 and second strike route 210.

In embodiments, a first strike jamb installation channel 202 or a second strike jamb installation channel 206 can be included. Shown also is stop 50*b*, adapted to be installed on either the hinge jamb or the strike jamb 200. A bore hole 204 to receive a doorknob latch is also shown.

The first strike jamb installation channel 202 and the second strike jamb installation channel 206 are offset from a center of the strike jamb 200, the first hinge jamb installation channel 302 and the second hinge jam installation channel 306 are offset from a center of the hinge jamb 300; and the first head jamb channel 102 and the second head jam channel 104, are offset from a center of the head jamb 100.

Figure 4A:
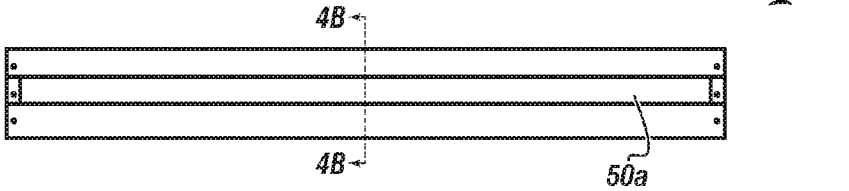
FIG. 4A depicts a head jamb according to one or more embodiments.
Figure 4B:
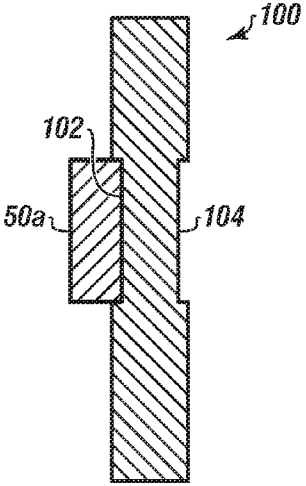
FIG. 4B depicts a cut view of FIG. 4A along line 4B-4B.

FIG. 4A depicts a head jamb according to one or more embodiments. FIG. 4B depicts a cut view of FIG. 4A along line 4B-4B.

The head jamb 100 is shown. In embodiments, a first head channel 102 or a second head channel 104 can be included. Shown also is stop 50*a*, adapted to be installed on the head jamb 100.

Figure 5A:
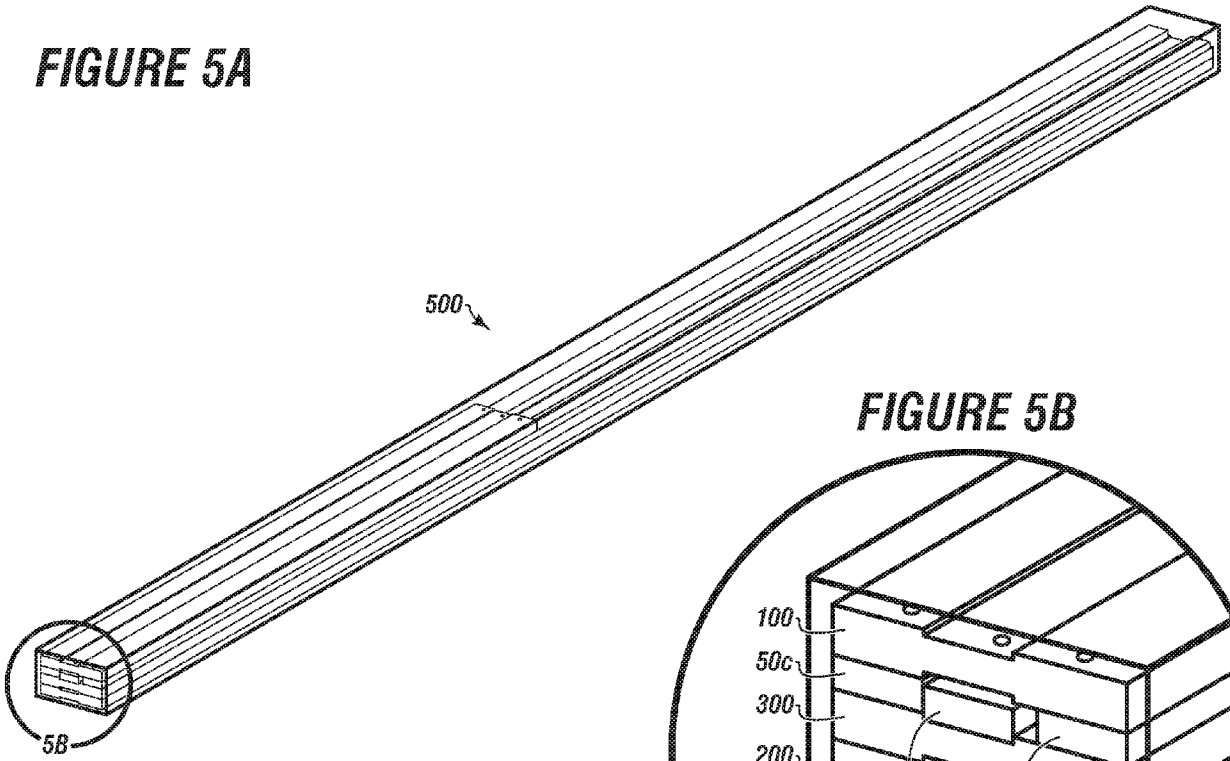
FIGS. 5A and 5B depict kit for constructing a reversible door jamb system according to one or more embodiments.
Figure 5B:
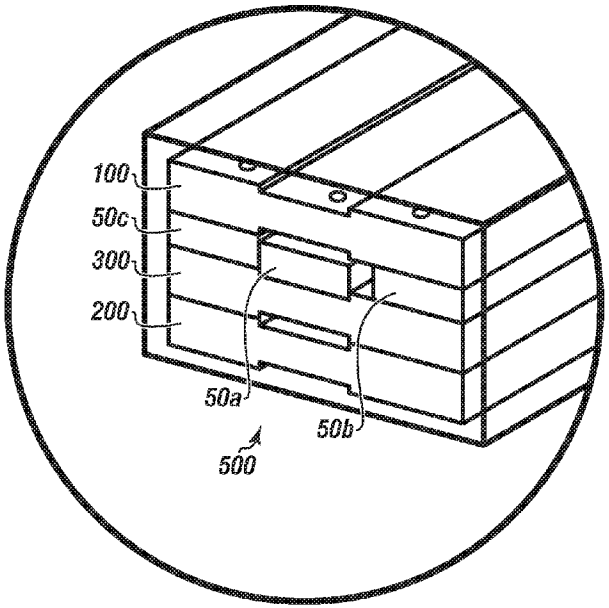

FIGS. 5A and 5B depict a kit for constructing a reversible door jamb system according to one or more embodiments.

A kit 500 is shown with all the components as described above. The kit 500 can include the head jamb 100, the strike jamb 200, and the hinge jamb 300. Also shown is stop 50*a*, adapted to be installed on the head jamb 100 and stops 50*b* and 50*c*, adapted to be installed on either the hinge jamb 300 or the strike jamb 200.

Figure 6:
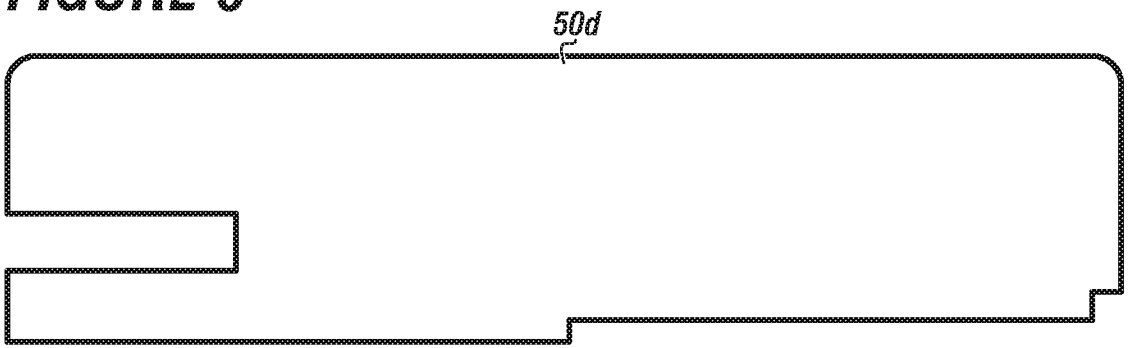
FIG. 6 depicts an exterior stop according to one or more embodiments.

FIG. 6 depicts an exterior stop according to one or more embodiments.

Stop 50*d* can be used for door frames intended for exterior doors. In embodiments, dimensions of the stop can vary depending upon application in the industry.

Figure 7:
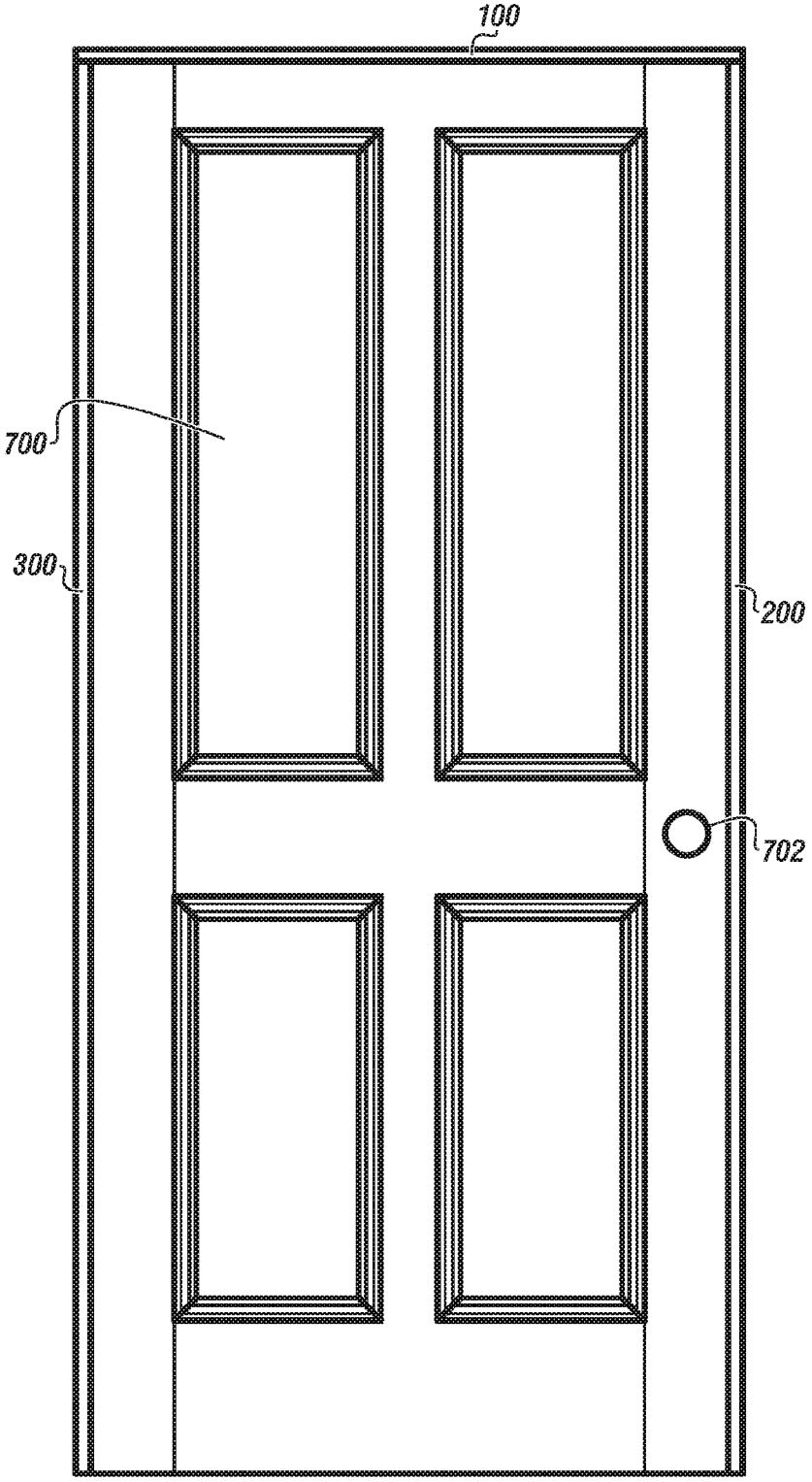
FIG. 7 depicts a door panel according to one more embodiments.

FIG. 7 depicts a door panel according to one or more embodiments.

A door panel 700 is shown with asymmetric handle bore 702. The door panel 700 can be attached to a door frame comprised of the head jamb 100, the strike jamb 200, and the hinge jamb 300.

The door panel can be attached to the door frame using methods commonly known to persons having ordinary skill in the art.

As can be seen from the above Figures. The strike jamb and the hinge jamb can be interchanged to easily change the handedness of the door panel. The strike jamb and the hinge jamb can be positioned on the right or the left side of the door frame, as well as rotated to position the hinge routes on the near side or far side of the door frame as desired.

This minimization of parts reduces the amount of inventory needed and makes it impossible to have the "wrong" parts on hand to install a door which swings open with the desired handedness.

While these embodiments have been described with emphasis on the embodiments, it should be understood that within the scope of the appended claims, the embodiments might be practiced other than as specifically described herein.

What is claimed is:

1. A reversible door jamb system for an aperture consisting of:

a. a door panel comprising:

(i) a handle bore positioned asymmetrically relative to a horizontal midline axis of the door panel; and (ii) a plurality of predrilled hinge routes configured to receive door hinges for left handed or right handed swinging;

b. a door frame for supporting the door panel comprising:

(i) a hinge jamb comprising:

(1) a plurality of first hinge jamb routes to receive door hinges; and (2) a plurality of second hinge jamb routes, wherein the plurality of second hinge jamb routes mirror the orientation of the plurality of first hinge jamb routes enabling mounting of the door panel for either left handed or right handed opening of the door;

(ii) a strike jamb adapted to be oriented substantially parallel to the hinge jamb comprising:

(1) a first strike route; and (2) a second strike route, wherein the second strike route mirrors the orientation of the first strike route enabling left handed or right handed opening of the door;

(iii) a head jamb adapted to be oriented substantially orthogonally to the hinge jamb and the strike jamb with a head channel forming the reversible door jamb system;

(iv) a first strike jamb installation channel and a second strike jamb installation channel, each offset from a center of the strike jamb in a direction orthogonal to a plane defined by the aperture;

(v) a first hinge jamb installation channel and a second hinge jamb installation channel, each offset from a center of the hinge jamb in the direction orthogonal to the plane defined by the aperture;

(vi) a first head jamb installation channel and a second head jamb installation channel, each offset from a center of the head jamb in the direction orthogonal to the plane defined by the aperture; and (vii) a stop adapted to be mounted to the strike jamb, head jamb, or the hinge jamb; and wherein the hinge jamb and the strike jamb can be oriented on either side of the head jamb to allow the door panel to swing open with left handed opening or with right handed opening.

2. The reversible door jamb system of claim 1, wherein the door panel is from 72 inches to 120 inches in height.

3. The reversible door jamb system of claim 1, wherein the stop is an interior stop adapted to be mounted to an interior door frame or an exterior stop adapted to be mounted to an exterior door frame.

4. The reversible door jamb system of claim 1, wherein the hinge jamb, the strike jamb, and the head jamb are at least partially concealed by a trim or a covering.

5. A kit for constructing a reversible door jamb system for an aperture consisting of:

a. a door panel comprising:

(i) a handle bore positioned asymmetrically relative to a horizontal midline axis of the door panel; and (ii) a plurality of predrilled hinge routes configured to receive door hinges for left handed or right handed swinging;

b. a hinge jamb comprising:

(i) a plurality of first hinge jamb routes to receive door hinges; and (ii) a plurality of second hinge jamb routes, wherein the plurality of second hinge jamb routes mirror the orientation of the plurality of first hinge jamb routes enabling mounting of the door panel for either left handed or right handed opening of the door;

(iii) a first hinge jamb installation channel and a second hinge jamb installation channel, each offset from a center of the hinge jamb in a direction orthogonal to a plane defined by the aperture;

c. a strike jamb adapted to be oriented substantially parallel to the hinge jamb comprising:

(i) a first strike route; and (ii) a second strike route, wherein the second strike route mirrors the orientation of the first strike route enabling left handed or right handed opening of the door;

(iii) a first strike jamb installation channel and a second strike jamb installation channel, each offset from a center of the strike jamb in the direction orthogonal to the plane defined by the aperture;

d. a head jamb adapted to be oriented substantially orthogonally to the hinge jamb and the strike jamb with a head channel forming a reversible door jamb system and a first head jamb installation channel and a second head jamb installation channel, each offset from a center of the head jamb in the direction orthogonal to the plane defined by the aperture; and e. a stop adapted to be mounted to the strike jamb, head jamb or the hinge jamb; and wherein the kit is configured to orient the hinge jamb and the strike jamb on either side of the head jamb to allow the door panel to swing open with left handed opening or right handed opening.

* * * * *